US005580237A

United States Patent [19]

Leger

[11] Patent Number: 5,580,237

[45] Date of Patent: Dec. 3, 1996

[54] OXIDANT LANCING NOZZLE

[75] Inventor: Christopher B. Leger, White Plains, N.Y.

[73] Assignee: Praxair Technology, Inc., Danbury, Conn.

[21] Appl. No.: 401,376

[22] Filed: Mar. 9, 1995

[51] Int. Cl.[6] ..... F23C 5/00

[52] U.S. Cl. ..... 431/8; 431/10; 239/558; 239/559; 239/425; 239/434.5

[58] Field of Search ..... 431/8, 10, 177; 239/425, 434.5, 433, 554, 558, 565, 556

[56] References Cited

U.S. PATENT DOCUMENTS

| | | | |
|---|---|---|---|
| 2,613,737 | 10/1952 | Schwietert | 239/425 |
| 4,556,384 | 12/1985 | Laurenceau et al. | 431/160 |
| 4,969,814 | 11/1990 | Ho et al. | 431/8 |
| 5,100,313 | 3/1992 | Anderson et al. | 431/8 |
| 5,110,285 | 5/1992 | Snyder et al. | 431/8 |
| 5,143,297 | 9/1992 | De Michele et al. | 239/433 |
| 5,176,324 | 1/1993 | Furuse et al. | 239/433 |
| 5,266,024 | 11/1993 | Anderson | 431/11 |
| 5,266,025 | 11/1993 | Francis, Jr. et al. | 431/187 |

*Primary Examiner*—Carroll B. Dority
*Attorney, Agent, or Firm*—Stanley Ktorides

[57] ABSTRACT

An oxidant lancing nozzle and lancing method wherein first and second oxidant streams are injected into a combustion zone under defined conditions enabling the lancing of oxygen to augment a main combustion reaction with improved flame stability and unchanged or even reduced $NO_x$ formation.

10 Claims, 1 Drawing Sheet

OXIDANT LANCING NOZZLE

TECHNICAL FIELD

This invention relates generally to oxidant nozzles and is particularly useful for injecting oxygen into a combustion zone to augment a main combustion reaction.

BACKGROUND ART

The production rate of a furnace, such as a cement kiln, especially one which is directly fired by a fuel/ air main combustion reaction, may be increased by lancing oxygen into the furnace to augment the main combustion reaction. However, the use of oxygen may cause an increase in the formation of nitrogen oxides ($NO_x$). Nitrogen oxides are environmentally deleterious and their excessive formation in a production process is undesirable.

Accordingly it is an object of this invention to provide an improved oxidant lancing nozzle which may be used to effectively inject oxidant into a combustion zone, especially directly into a fuel stream or a fuel/air mixture.

It is another object of this invention to provide a method for lancing oxidant into a combustion zone in a manner which will not cause increased $NO_x$ formation.

It is a further object of this invention to provide an improved oxidant lancing nozzle and method which will improve flame stability relative to the situation where only air is used as the oxidant.

SUMMARY OF THE INVENTION

The above and other objects which will become apparent to one skilled in the art upon a reading of this disclosure are attained by the present invention, one aspect of which is:

An oxidant lancing nozzle comprising:

(A) a nozzle body having a surface and a centerline;

(B) at least one first passage oriented within the nozzle body communicating with the nozzle surface and oriented at a first outward angle from the centerline; and (C) at least one second passage within the nozzle body communicating with the nozzle surface closer to the centerline than where said first passage communicates with the nozzle surface, and oriented at a second outward angle from the centerline which is greater than said first outward angle from the centerline.

Another aspect of the invention is:

A method for lancing oxidant into a combustion zone comprising:

(A) injecting at least one first oxidant stream into the combustion zone through a nozzle having a centerline at a first velocity and at a first outward angle from the centerline;

(B) injecting at least one second oxidant stream into the combustion zone through the nozzle at a second velocity, which is less than said first velocity, and at a second outward angle from the centerline which is greater than said first outward angle from the centerline; and (C) wherein the said second oxidant stream is injected into the combustion zone closer to the centerline than the said first oxidant stream is injected into the combustion zone.

As used herein the term "oxygen" means a fluid having an oxygen concentration which equals or exceeds 22 mole percent. Preferably oxygen is in the form of a fluid having an oxygen concentration which equals or exceeds 30 percent.

As used herein the term "lancing" means injecting oxidant, such as oxygen, into a vessel, such as a kiln.

As used herein the term "kiln" means a cylindrical furnace that is tilted and rotates on its longitudinal axis to move solids along its axis and which is directly fired with a fuel/oxidant flame in a countercurrent configuration.

As used herein the term "nozzle surface" means the outer portion of a nozzle through which oxidant may pass into a combustion zone. The nozzle surface includes the nozzle face and the nozzle sides.

As used herein the term "combustion zone" means a volume into which oxidant may be injected from a nozzle.

DETAILED DESCRIPTION

This invention will be described in detail with reference to the Drawings.

Figure 1:
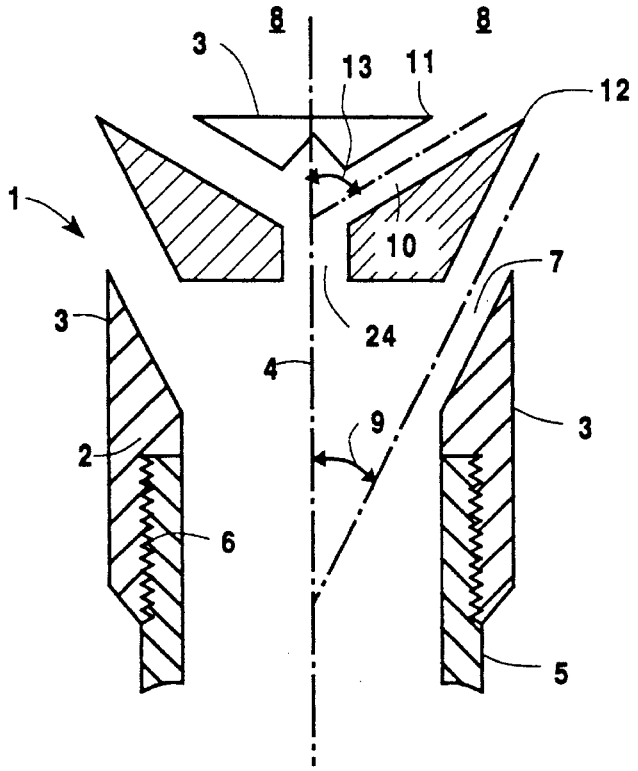
FIG. 1 is a simplified cross-sectional. representation of one preferred embodiment of the oxidant lancing nozzle of this invention.

Referring now to FIG. 1, oxidant lancing nozzle 1 comprises nozzle body 2 having a nozzle surface 3. Centerline 4 is an imaginary line running axially through the center of nozzle body 2. Nozzle 1 may be attached to oxidant provision conduit 5 by screw threads 6 or any other suitable means. Nozzle 1 may be comprised of any suitable material such as copper, stainless steel, refractory metals, refractory metal alloys or ceramic materials.

At least one first passage 7 passes through nozzle body 2 and communicates with nozzle surface 3. First passage 7 may be a single annular passage or may be one or more, generally from 8 to 12, individual passages, serving to enable oxidant to pass from oxidant provision conduit 5 through nozzle body 2 and past nozzle surface 3 into combustion zone 8. First passage 7 is oriented at a first outward angle 9 from centerline 4. First outward angle 9 is within the range of from 0 to less than 90 degrees, preferably from 10 to 50 degrees from the centerline. In the embodiment illustrated in FIG. 1, first outward angle 9 is 30 degrees from centerline 4.

At least one second passage 10 passes through nozzle body 2 and communicates with nozzle surface 3 at a point, such as 11, which is radially closer to centerline 4 than where first passage 7 communicates with nozzle surface 3, e.g. point 12. Second passage 10 may be a single annular passage or may be one or more, generally from 8 to 12, individual passages, serving to enable oxidant to pass from oxidant provision conduit 5 through nozzle body 2 and past nozzle surface 3 into combustion zone 8. Second passage 10 is oriented at a second outward angle 13 from centerline 4. Second outward angle 13 is greater than first outward angle 9 and is within the range of from greater than 0 to 90 degrees, preferably from 30 to 80 degrees from the centerline. In the embodiment illustrated in FIG. 1, second outward angle 13 is 60 degrees from centerline 4.

The operation of the oxidant lancing nozzle of this invention will be described with reference to FIG. 2. The numerals of FIG. 2 correspond to those of FIG. 1 for the common elements and these common elements will not be described again in detail.

Figure 2:
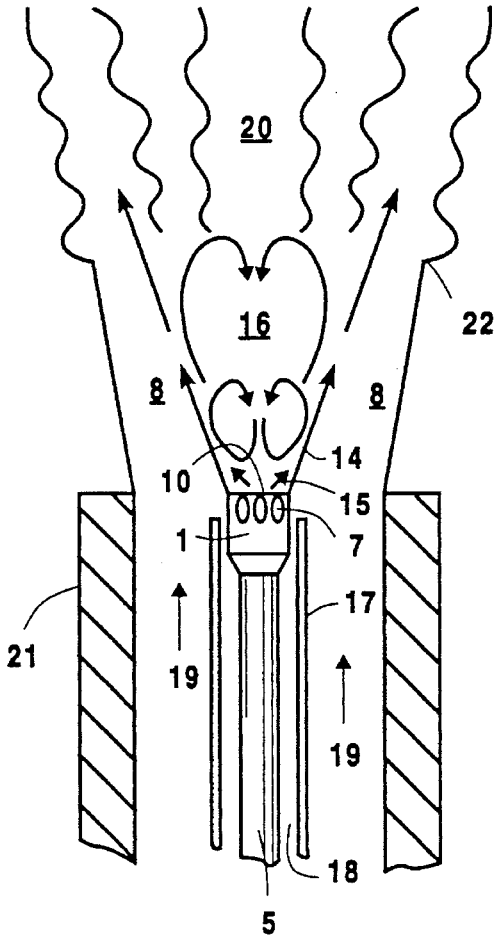
FIG. 2 is a simplified representation of one preferred embodiment of the oxidant lancing method of this invention.

Referring now to FIG. 2, oxidant is provided to oxidant nozzle 1 by oxidant provision conduit 5. The oxidant may be air but is preferably oxygen. Preferably the oxygen is a fluid having an oxygen concentration of at least 30, most preferably at least 90, mole percent. The oxygen may also be commercially pure oxygen having an oxygen concentration of 99.5 mole percent or more.

The oxidant is lanced from oxidant nozzle 1 into combustion zone 8 in at least one first oxidant stream 14 and at least one second oxidant stream 15. The first oxidant stream is injected into combustion zone 8 at the first outward angle through first passage 7 and the second oxidant stream is injected into combustion zone 8 at the second outward angle through second passage 10. The second oxidant stream 15 is injected into combustion zone 8 closer to the centerline of nozzle 1 than is first oxidant stream 15.

First oxidant stream 14 is injected into combustion zone 8 at a first velocity which is generally within the range of from 50 to 2000 feet per second (fps), preferably from 500 to 1100 fps and second oxidant stream 15 is injected into combustion zone 8 at a second velocity, which is less than the first velocity, and is generally within the range of from 10 to 300 fps, preferably within the range of from 100 to 200 fps.

The velocity of the outer or first oxidant stream(s) is controlled by the oxidant supply pressure as it issues from conduit 5. The size of the first passage(s) 7 is selected to provide the desired oxidant flow rate at the supply pressure necessary to provide the desired velocity. The second oxidant passage(s) 10 is supplied with the same oxidant supply pressure, however oxidant must first pass through a single common passage 24 which has a smaller flow area than the total of second oxidant passage(s) 10. As a result, the common passage 24 limits the total oxidant flow into the second oxidant passage(s) 10 causing a reduction in the velocity of the second oxidant as it exists the nozzle. For a given size of second oxidant passage(s) 10 and a given oxidant supply pressure, the total flow and velocity of the second oxidant stream may be increased by enlarging common passage 24.

Preferably as illustrated in FIG. 2, the first velocity is sufficiently high to cause a recirculation zone 16 to form within the combustion zone proximate the nozzle face. The second oxidant stream, as illustrated in FIG. 2, is preferably injected from the nozzle into recirculation zone 16 at an outward angle 13 which promotes the recirculation. Hot, partially combusted fuel is transported by the recirculation zone to the vicinity of the nozzle face, i.e. that portion of the nozzle surface perpendicular to centerline 4. The second oxidant stream(s) enters this hot combustible mixture and reacts with the hot fuel to create a flame. The velocity of the second oxidant stream should preferably remain below about 200 fps to prevent it from blowing off the flame or causing an unstable oscillation of the flame front. The flame formed by the second oxidant stream(s) in the recirculation zone is carried to the vicinity of the first oxidant stream(s) where it becomes entrained. The first oxidant stream(s) entrains both cold fuel/air mixture 19 and flame formed by the second oxidant stream(s). The first oxidant stream(s) then contains fuel, oxygen and an ignition source so it forms its own flame. Although the velocity of the first oxidant stream(s) is generally high enough to cause a flame to blow off under conventional operation, the flame generated by the practice of this invention remains stably ignited because it continuously entrains flame from the second oxidant stream(s).

The invention is particularly useful for lancing oxidant directly into the main combustion reaction of a kiln or other furnace. In the embodiment illustrated in FIG. 2, oxidant provision conduit 5 is located within conduit 17 which is used for support. Fuel or a fuel/air mixture is provided into combustion zone 8, as shown by 19, coaxially to the first and second oxidant through conduit 21. Alternatively or in addition to stream 19, fuel or a fuel/air mixture 18 may be provided into combustion zone 8 coaxially to the first and second oxidant through conduit 17. The fuel may be any suitable fuel such as, for example, pulverized coal, pulverized petroleum coke, fuel oil, kerosene, waste solvents or natural gas.

The fuel combusts with the oxidant provided into the combustion zone with the first oxidant stream and the fuel/air mixture combusts in a main combustion reaction downstream of the recirculation zone such as is shown at area 20. The injection of the oxidant proximate the fuel of the main combustion reaction enables the use of oxygen for productivity enhancement without increasing $NO_x$ generation. The invention enables the advantageous proximate injection of oxidant while improving flame stability. Combustion occurs in the recirculation zone 16 and remains attached to the nozzle face. Combustion also occurs along the first oxygen stream(s) 14, and at all locations downstream of first oxygen stream(s) 14. A plume of unignited fuel/air mixture surrounds the combustion zone until the point where the flames in stream 14 reach the radial outer surface of the fuel/air stream as shown by point 22 in FIG. 2. At this point and for all locations downstream of it, the entire stream of fuel/air mixture is combusting.

The invention will find particular utility for use in the operation of a cement kiln. Other uses of the invention include its use in the operation of a lime kiln, an incinerator, an ore processing kiln or a drying kiln or any other suitable combustion application.

Although the invention has been described in detail with reference to certain preferred embodiments, those skilled in the art will recognize that there are other embodiments of the invention within the spirit and the scope of the claims.

I claim:

1. An oxidant lancing nozzle comprising:

(A) a nozzle body having a surface and a centerline;

(B) at least one first passage oriented within the nozzle body communicating with the nozzle surface and oriented at a first outward angle from the centerline, and having a size for injecting oxidant at a first oxidant velocity; and (C) at least one second passage within the nozzle body communicating with the nozzle surface closer to the centerline than where said first passage communicates with the nozzle/face, and oriented at a second outward angle from the centerline which is greater than said first outward angle from the centerline, and having a size for injecting oxidant at a velocity which is less than the first oxidant velocity.

2. The nozzle of claim 1 having a plurality of first passages.

3. The nozzle of claim 1 having a plurality of second passages.

4. A method for lancing oxidant into a combustion zone comprising:

(A) injecting at least one first oxidant stream into the combustion zone through a nozzle having a centerline at a first velocity and at a first outward angle from the centerline;

(B) injecting at least one second oxidant stream into the combustion zone through the nozzle at a second velocity, which is less than said first velocity, and at a second outward angle from the centerline which is greater than said first outward angle from the centerline; and (C) wherein the said second oxidant stream is injected into the combustion zone, from a surface of the nozzle closer to the centerline than the said first oxidant stream is injected into the combustion zone.

5. The method of claim 4 wherein a plurality of first oxidant streams are injected into the combustion zone.

6. The method of claim 4 wherein a plurality of second oxidant streams are injected into the combustion zone.

7. The method of claim 4 wherein there is formed a recirculation zone within the combustion zone proximate the nozzle surface at its face and the second oxidant stream is injected into the recirculation zone.

8. The method of claim 4 further comprising providing fuel into the combustion zone.

9. The method of claim 4 further comprising providing a mixture of fuel and air into the combustion zone.

10. The method of claim 4 wherein at least one of the first oxidant stream and the second oxidant stream comprises oxygen.

* * * * *